United States Patent [19]

Collins et al.

[11] Patent Number: 4,782,267

[45] **Date of Patent: * Nov. 1, 1988**

[54] IN-SITU WIDE AREA VACUUM ULTRAVIOLET LAMP

[75] Inventors: George J. Collins, Fort Collins; Zeng-qi Yu, Fort Collins, both of Colo.

[73] Assignee: Applied Electron Corporation, Albuquerque, N. Mex.

[ * ] Notice: The portion of the term of this patent subsequent to Apr. 9, 2002 has been disclaimed.

[21] Appl. No.: 827,336

[22] Filed: Feb. 7, 1986

[51] Int. Cl.[4] ..... C23C 13/08; B05D 3/06

[52] U.S. Cl. ..... 315/111.81; 118/50.1; 118/620; 118/723; 427/39; 313/231.31; 313/637; 313/231.61; 313/362.1; 204/164; 315/358

[58] Field of Search ..... 315/111.01, 111.21, 315/111.81, 358, 111.31, 111.81; 313/35, 22, 12, 390, 387, 423, 362.1, 352, 334, 46, 30.9, 32, 356, 637, 631, 621, 618, 615, 608, 575, 574, 573, 572, 454, 112, 632, 250, 259, 264, 346 R; 328/255; 445/73; 220/2.1 R; 219/121; 427/38, 39, 40, 42; 118/50.1, 620, 723; 204/164

[56] References Cited

U.S. PATENT DOCUMENTS

| | | | |
|---|---|---|---|
| 3,990,038 | 11/1976 | Jensen et al. | 313/423 |
| 4,145,635 | 3/1979 | Tuck | 313/309 |
| 4,336,277 | 6/1982 | Bunshah et al. | 427/38 |
| 4,340,837 | 7/1982 | Meyer | 313/268 |
| 4,509,451 | 4/1985 | Collins et al. | 118/50.1 |
| 4,560,880 | 12/1985 | Petric et al. | 219/121 |
| 4,583,023 | 4/1986 | Friedman et al. | 313/352 |
| 4,608,063 | 8/1986 | Kurokawa | 427/38 |
| 4,620,913 | 11/1986 | Bergman | 427/38 |
| 4,657,774 | 4/1987 | Satou et al. | 427/38 |

OTHER PUBLICATIONS

Desilets, "Plasma Etching Chamber," 12/1983, IBM Technical Disclosure Bulletin, vol. 26, No. 7B, pp. 3567-3569.

*Primary Examiner*—Leo H. Boudreau
*Assistant Examiner*—Mark R. Powell
*Attorney, Agent, or Firm*—William E. Hein

[57] ABSTRACT

An open wide area vacuum ultraviolet lamp for use in microelectronics processing applications employes a ring-shaped cold cathode to produce a trapped electron beam discharge of generally disc-shaped cross section in a low pressure molecular gas environment and without the use of VUV windows.

24 Claims, 3 Drawing Sheets

IN-SITU WIDE AREA VACUUM ULTRAVIOLET LAMP

BACKGROUND OF THE INVENTION

This invention relates generally to wide area vacuum ultraviolet (VUV) light sources that are disc-like in shape and more specifically to such a light source that is created by employing a ring-shaped abnormal glow discharge electron gun that produces a flat disc-shaped trapped electron beam generated plasma.

Photo-exposure, decomposition, and cross-linking of polymer materials all require a VUV light source of wide area. In addition, photo-assisted chemical vapor deposition, etching, and growth of organic or inorganic based microelectronic, photovoltaic, and electro-optic films also require a wide area VUV light source of disc-like geometry to promote rapid low temperature processing of materials in such a way that they remain free of plasma radiation damage. Photodeposition of hydrogenated amorphous silicon requires a VUV light source, for example, when using monosilane as a feedstock gas. There is a strong need for VUV light sources in all of these applications and many others. Of special interest are wide area VUV lamps providing a source of photons as well as a source of ground state and excited atomic species. Sensitized atommolecule reactions can both dissociate feedstock gases and may assist heterogeneous surface reactions.

Conventional VUV light sources include both high pressure and low pressure gas discharge lamps. Enclosed low pressure mercury-xenon lamps and high pressure xenon arc lamps have both been employed as VUV light sources. These lamps are excited by either a radio frequency or D.C. electrical source. A VUV transmitting window is necessary for such lamps. A VUV lamp usually requires special window materials, such as $MgF_2$, LiF, sapphire, $CaF_2$ to transmit VUV resonance light. The window material is often hydroscopic, degrades its VUV transmission with time, and is expensive to replace. Removal of the more intense infrared/optical spectra can be achieved via wavelength filtering of the output radiation from such enclosed lamps.

Conventional VUV light sources also include hollow cathode lamps with or without VUV windows. Such hollow cathode lamps are usually cylindrical rather than disc-like lamps and have a small circular area ($<3$ $cm^2$). The hollow cathode lamp has the ability to generate a self-contained and localized discharge. That is, it can operate within a microelectronics processing chamber without exciting a large and diffuse volume plasma within the chamber. However, the hollow cathode is a closed wall structure that substantially prevents ouldiffusion of atomic species created in the plasma region. Moreover, substantial undesired cathode sputtering occurs in the hollow cathode.

Conventional lamps then (with the exception of hollow cathodes) employ both VUV windows and enclosure wall to maintain the specific lamp gases at the required pressure within the lamp. The need for a VUV window having a high optical transmission chrracteristic, the additional need for a source of excited atomic species, and the creation of wide area illumination of disc-like geometry in the VUV spectral region are all major problems associated with conventional VUV lamps. VUV lamps having diameters equal to or greater than 2–5 centimeters are simply not possible using previous gas discharge methods described above. Conventional enclosed VUV lamps are limited in circular area to dimensions less than several square centimeters. Hence, they can directly illuminate only a portion of a 5 centimeter to a 20 centimeter diameter substrate used in silicon or III-V microelectronics manufacture as well as in large area solar cells or flat panel displays.

Conventional enclosed VUV lamps using $D_2$ or $H_2$, for example, as a gaseous medium only create VUV radiation. They do not create and allow atomic hydrogen or atomic deuterium to diffuse unimpeded from the lamp plasma into the region between the lamp and the substrate. Conventional enclosed VUV lamps have closed wall structures that inhibit or prevent the diffusion of atomic fragments from the localized plasma region into the microelectronic processing chamber, especially over a wide area. Conventional lamps have walls and windows that are not open in structure as is the case for the ring cathode structure taught in accordance with the present invention. Hence, diffusion of atomic species from the plasma cannot occur over a wide area, if at all, for closed wall conventional VUV lamps. These atomic species can be used in sensitized atom-molecule reactions to cause dissociation of the feedstock reactant gas phase molecules used in microelectronic, photovoltaic, and electro-optic films or to assist surface reactions on substrates.

SUMMARY OF THE INVENTION

The open wide area vacuum ultraviolet (VUV) lamp of the present invention can be located directly inside a microelectronics processing chamber for use in photo dissociat1ng feedstock molecules and providing external energy to assist surface reactions. The open VUV lamp of the present invention can also provide a source of excited neutral atoms that may participate in sensitized atom-molecule dissociation reactions. The dissociated reactant molecules have products that may be used for photon assisted etching, photon assisted deposition or photo modification of polymer and inorganic films, such as PMMA or hydrogenated amorphous silicon.

This wide area source of both VUV photons and atomic species is made possible by an open lamp structure having little closed wall area. A ring-shaped cathode geometry without a center anode permits formation of a disc-shaped trapped electron beam, which has a lower discharge impedance than those cathode geometries employed in the prior art. The disc-shaped trapped electron beam created plasma contains the high energy electrons within the ring-shaped cathode by electrostatic reflection and generates VUV radiation in a low pressure molecular gas such as deuterium, oxygen, hydrogen or nitrogen. Oxygen or nitrogen may be mixed with atomic helium, $D_2$ or $H_2$ to minimize cathode sputtering by the formation of a thin oxide or nitride layer on the cathode surface. The major advantages of the VUV radiation emitted from this disc-shaped trapped electron beam plasma is that it occurs over a large area, typically 5 to 20 centimeters in diameter, and no VUV windows are required. Radiation trapping effects will result in a diffuse volume of VUV radiation surrounding the disc region. The VUV radiation will be used for photon assisted processing of microelectronic, photovoltaic, and electro-optic films.

The open VUV lamp of the present invention is located within the microelectronics processing chamber, yet the electron beam created plasma occurs only within the localized disc region. Unlike radio frequency or direct current excitation, the beam created plasma is spatially confined to only a fraction of the chamber volume, thereby minimizing undesired volume reactions that dissociate feedstock molecules far (1–10 centimeters) from the substrate surface. These volume reactions often result in particle generation. The open VUV lamp of the present invention operates without the need for optical windows that are able to transmit VUV radiation only with limited success. Unlike the prior art which employs an anode in direct contact with the electron beam plasma, the present invention does not employ an anode as such. Also unlike the prior art which describes operation in the normal glow discharge state, the open VUV lamp of the present invention operates in the abnormal glow discharge state.

The present open VUV lamp will run in-situ in $D_2$, $H_2$, $N_2$, $O_2$, and helium background gases at pressures from 1 to 25 Torr as well as in mixtures of these gases. Reactant gases that may comprise various hydrocarbons such as $CH_4$, $C_2H_6$, MMA, etc. as well as inorganic gases such as $SiH_4$ are introduced at lower partial pressures so that cathode sputtering is minimized. The VUV radiation from D(121.5 nm), H(121.6 nm), N(120 nm), O(130 nm), and He(58 nm) is able to directly photodissociate polyatomic feedstock molecules, such as $SiH_4$, $CH_4$, and $C_2H_6$ which absorb strongly only in the VUV region and absorb very little in the untraviolet. UV lamps operating from 200 to 400 nanometers are ineffective in direct photo dissociation of $SiH_4$, $CH_4$, and $C_2H_6$ molecules because the UV absorption coefficient is too low.

The in-situ VUV lamp of the present invention, when working with molecular $D_2$, $H_2$, $O_2$ or $N_2$ gas, also acts as a dissociation source for producing atomic deuterium, hydrogen, oxygen or nitrogen. The numerous ground state atomic hydrogen, oxygen or nitrogen atoms that diffuse far (1–10 cm) from the confined disc of beam electrons can subsequently be pumped up to excited neutral levels following absorption of resonance radiation emitted from the plasma disc. The plasma disc region emits strong VUV resonance radiation; from 50 to 80 percent of the electron beam energy may go into atomic resonance radiation. Optical pumping of ground state atoms by VUV resonance radiation can occur far (1–10 cm) from the plasma lamp volume itself but within the optical line of sight.

VUV optical pumping of atomic ground state atoms raises their internal energy and allows them to participate in sensitized atom-molecule collisions which dissociate the reactant organic or inorganic polyatomic feedstock molecules used in microelectronics fabrication. That is, $A^* + \text{polyatomic} \rightarrow A + \text{dissociation products}$, where $A^*$ is a photoexcited species. Dissociation products share among themselves the original internal energy of the excited neutral atom. Following the excited atom-molecule collision the atom returns to the ground state. It can then absorb another photon emitted from the open VUV lamp and possibly dissociate another feedstock molecule in a subsequent atom-molecule reaction.

DESCRIPTION OF THE ILLUSTRATED EMBODIMENTS OF THE INVENTION

Figure 1:
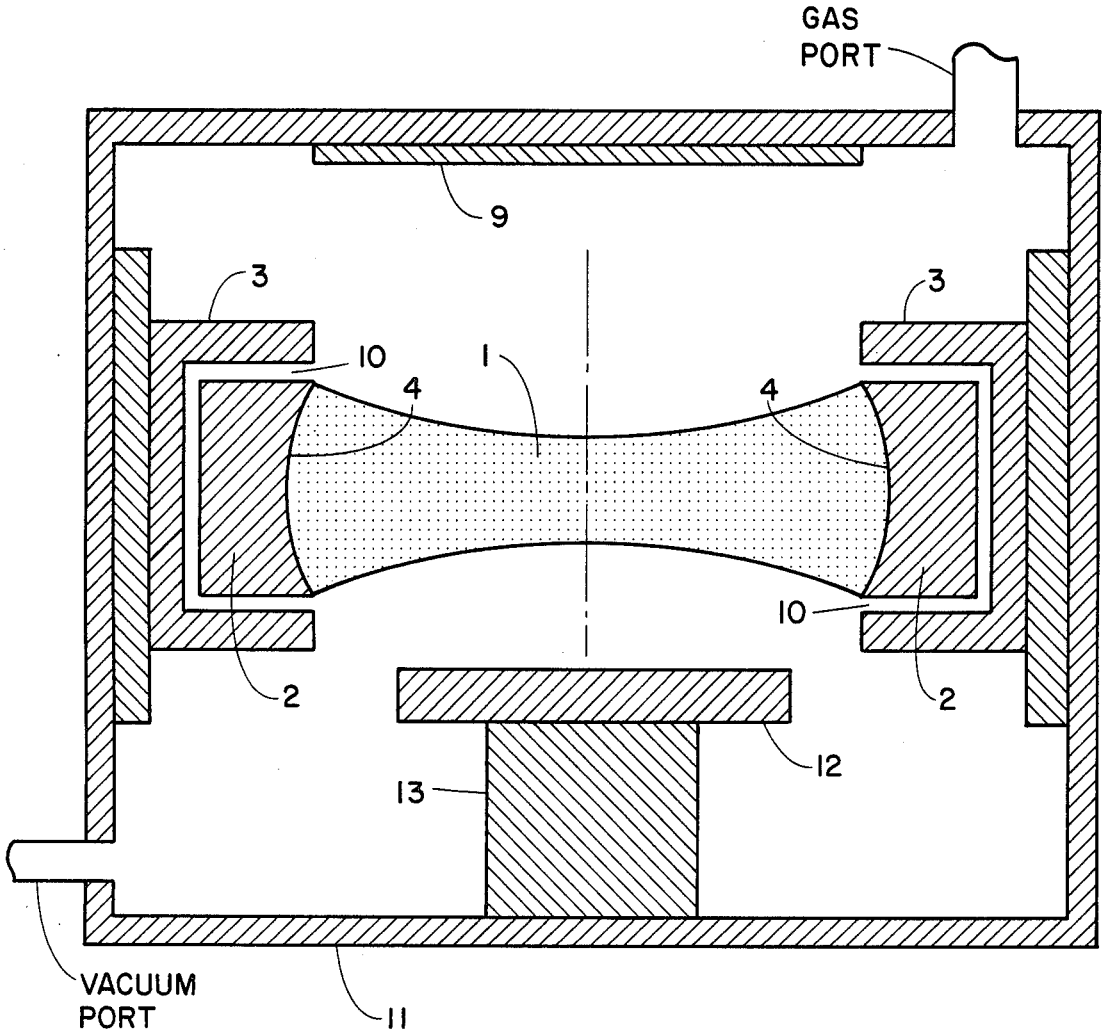
FIG. 1 is an illustration in cross-section of a microelectronics processing chamber containing a VUV lamp, constructed in accordance with one embodiment of the present invention, for producing a disc-like trapped electron beam plasma that emits VUV light and also acts as a dissociation source for atomic species created in the electron beam plasma region.

Referring now to FIG. 1, there is shown a cross-sectional pictorial representation of an in-situ, open wide area vacuum ultraviolet (VUV) lamp constructed in accordance with the present invention. A concave front surface 4 of a ring-shaped cathode 2 operating in the abnormal glow discharge state emits secondary electrons following ion bombardment or the absorption of a VUV photon, thus providing, as an excitation source, a disc-shaped trapped electron beam generated discharge 1. The ring-shaped cathode 2 acts to contain energetic electrons by electrostatic reflection. The external electrical potential applied to the ring-shaped cathode 2 through a D.C. power supply 5, illustrated in FIG. 3, accelerates secondary electrons created at the cathode front surface 4 and generates a disc-shaped trapped electron beam discharge 1 without the need for an anode positioned within the disc-shaped trapped electron beam discharge 1. The disc-shaped trapped electron beam discharge 1 excites the surrounding ambient gas in electron-atom collisions. For molecular $O_2$, $N_2$, $D_2$, and $H_2$ gases the disc-shaped trapped electon beam discharge 1 acts as a wide area circular source of atomic species, as well as a wide area source of atomic VUV resonance radiation. The excited atoms within the disc-shaped trapped electron beam discharge 1 will emit VUV radiation primarily on their resonance lines. The resonance radiation can propagate to the substrate surface, far away from the spatially localized disc-shaped trapped electron beam discharge 1. A VUV reflective coating 9 is placed on one surface of a chamber 11 to direct the VUV backside radiation toward a substrate 12 that is held in a desired position by a support 13.

Figure 2:
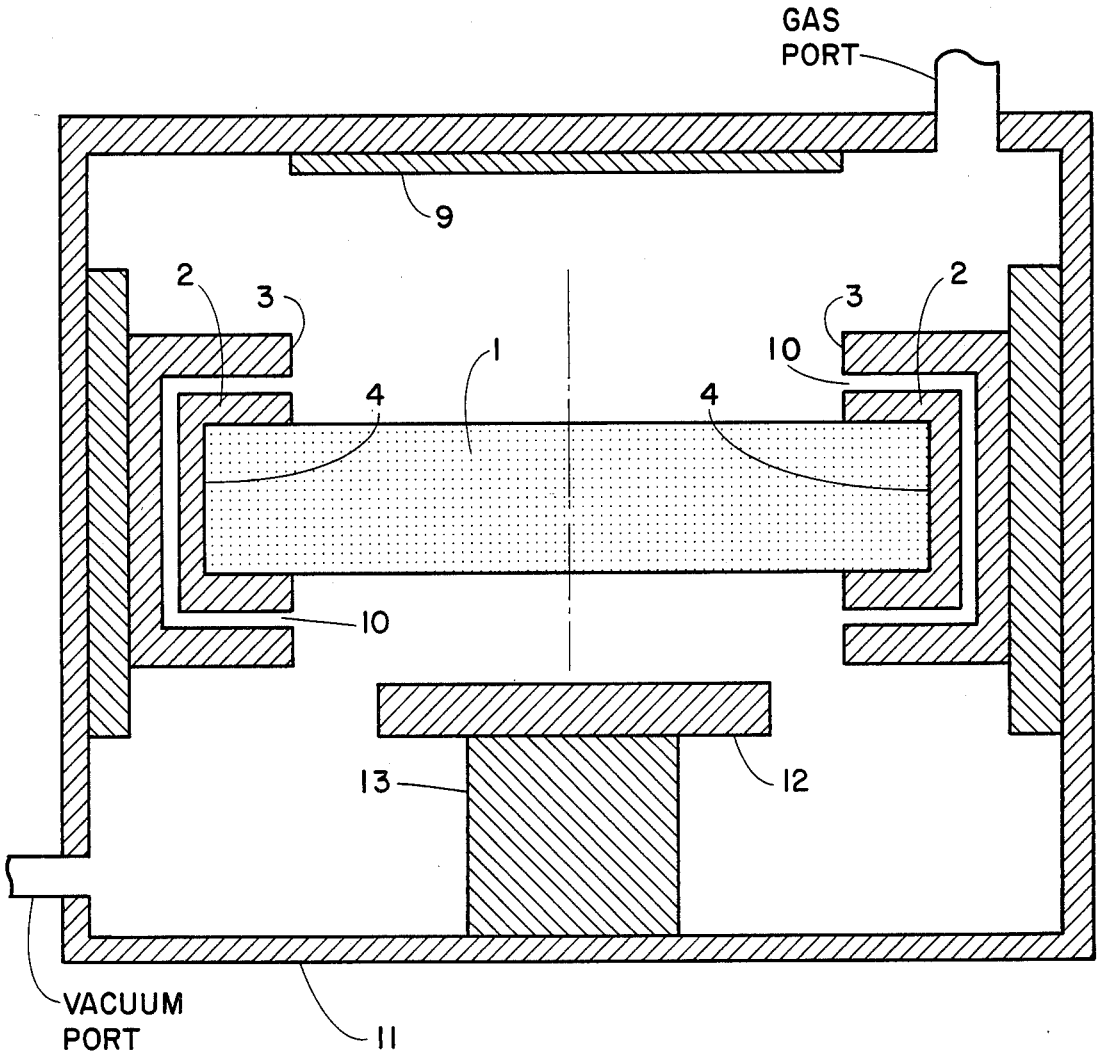
FIG. 2 is an illustration in cross-section of a microelectronics processing chamber containing a VUV lamp having a alternate cathode geometry.

A water or gas cooled cathode shell 3, illustrated in FIGS. 1 and 2, covers the outer surface of the emitting ring-shaped cold cathode 2 to insure operation in the abnormal glow discharge state, where beam electrons have greatest energy. The cathode shell 3 confines the beam created plasma to the volume inside the ring-shaped cold cathode 2, as illustrated in FIGS. 1 and 2. The choice of operating pressure (1 to 25 Torr) and shell-to-cathode spacing 10 (0.1 to 0.7 millimeters) prevents a discharge between the cathode shell 3 and the ring-shaped cold cathode 2 and insures that the energy contained within the disc-shaped trapped electron beam discharge 1 serves to excite the surrounding ambient gas rather than impinge upon an inner anode, as taught in the prior art. Geometrical shaping of the front surface 4 of the ring-shaped cold cathode 2 allows for electrostatic shaping of the disc-shaped trapped electron beam discharge 1. Both a concave front surface 4 of ring-shaped cold cathode 2, as illustrated in FIG. 1, and a U-shaped front surface 4, as illustrated in FIG. 2, have been successfully employed. Either water or gas circulation within ring-shaped cold cathode 2 or cathode shell 3 may be employed to dissipate the energy absorbed from ion bombardment that occurs in an operating plasma. Cooling via the cathode shell 3 is believed to be unique to the present invention and provides a number of practical advantages over direct cathode cooling.

The cathode shell 3 may be constructed of either a metal, such as stainless steel or aluminum, or a ceramic such as $Al_2O_3$, BeO or Mycor. When a metal cathode shell 3 is chosen, a thin layer of insulating material may be placed in space 10 between the ring-shaped cold cathode 2 and cathode shell 3. This insulating material provides both electrical isolation as well as mechanical support between ring-shaped cold cathode 2 and cathode shell 3. A machinable ceramic is preferred for use as this insulating material because it can be precisely machined to maintain the requirdd narrow space 10 of uniform dimension between the ring-shaped cold cathode 2 and the cathode shell 3. In the event cathode shell 3 is chosen to be a ceramic, space 10 may be eliminated and the ring-shaped cold cathode 2 may be fit snugly into cathode shell 3.

Materials from which the ring-shaped cold cathode 2 may be constructed are of a wide variety to meet the varying requirements of thin film processing including photo-assisted etching, photon assisted deposition, and photon modification of both inorganic and polymer films. Any material that may be chosen for ring-shaped cold cathode 2 should have a high secondary electron emission coefficient to achieve high efficiency operation. A low sputtering yield for the selected cathode material is also desired. Suitable cathode materials may comprise heavily doped and lightly doped silicon, molybdenum, magnesium, tantalum, aluminum, and graphite. A sintered metal-ceramic (CERMET) mixture of: silicon and silicon dioxide, magnesium and aluminum oxide or molybdenum and aluminum oxide is also suitable, as are calcium, strontium, and barium oxides and their mixtures.

Figure 3:
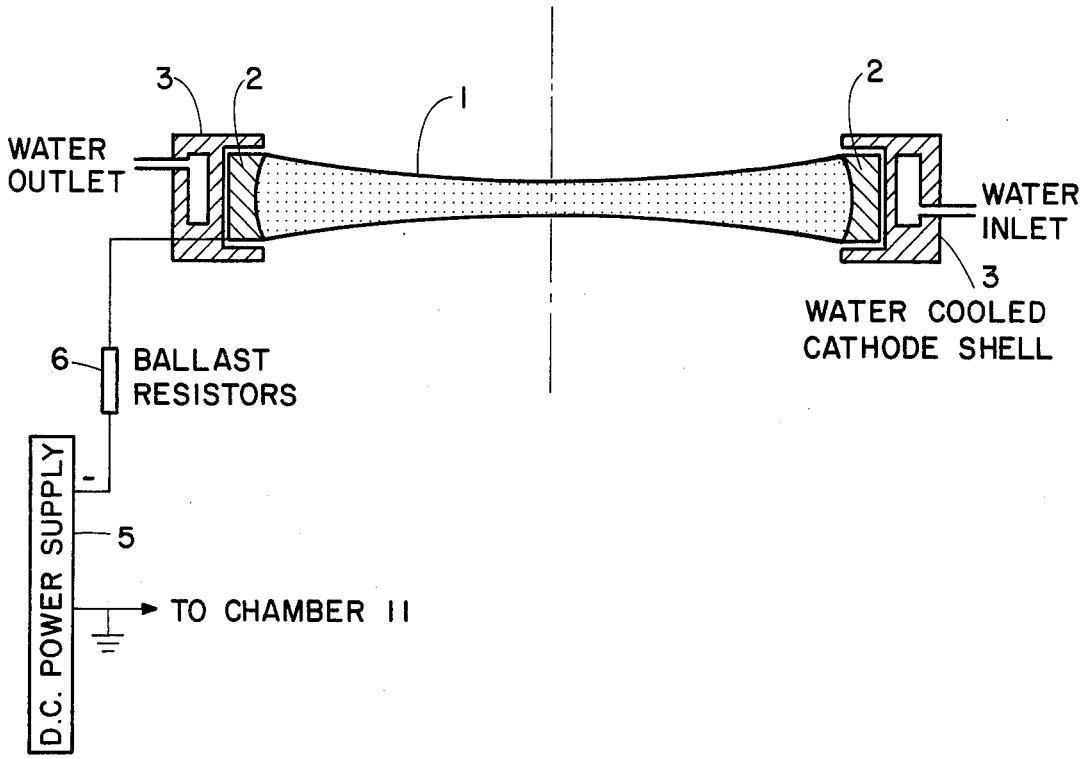
FIG. 3 illustrates electrical, vacuum, and cooling connections for the electron beam excited VUV lamps of FIGS. 1 and 2.

The D.C. power supply 5 of FIG. 3 is connected to the ring-shaped cold cathode 2 and to the grounded chamber 11, shown in FIGS. 1 and 2, through a group of ballast resistors 6. A disc-shaped trapped electron beam discharge 1 occurs when a reduced pressure ambient is achieved.

If the wide area VUV lamp of the present invention is operated in molecular $D_2$, $H_2$, $O_2$ or $N_2$ the disc-shaped trapped electron beam discharge 1 dissociates a fraction of the molecules into atomic species. The ground state atomic species that diffuse into the reactor can be subsequently optically excited by resonance radiation originating from the disc-shaped trapped electron beam discharge 1 to form excited neutral atoms near the substrate 12. For example, D radiation at 121.5 nanometers, H radiation at 121.6 nonometers, O radiation at 130 nanometers, N radiation at 120 nanometers, and He radiation at 58 nanometers will resonantly excite ground state D, H, 0, N, and He atomic species, respectively. Excited, rather than ground state atoms participate in sensitized atom-molecule dissociation reactions; $A^* + \text{polyatomic} \rightarrow A + \text{fragments}$. The photo-excited D(2p), H(2p), $O(1s^2 2s^2 2p^3 3s)$, He(2p) and $N(1s^2 2s^2 2p^2 3s)$ atoms can participate in sensitizedatom-molecule volume reactions to dissociate reactant molecules as well as assist surface reaction in the etching, deposition, and film modification sequence of both organic and inorganic films used in microelectronics, photovoltaics, and electro-optics.

We claim:

1. An in-situ wide area vacuum ultraviolet radiation apparatus, the apparatus comprising:

vacuum chamber means;

a ring-shaped cold cathode within said vacuum chamber means having a geometrically shaped inner surface comprising a material selected for the efficient emission of secondary electrons and for minimum cathode sputtering;

a ring-shaped cathode shell coaxially covering an outer surface of said ring-shaped cold cathode;

D.C. power supply means electrically connected to said ring-shaped cold cathode and to the vacuum chamber means for accelerating secondary electrons emitted from the inner surface of said ring-shaped cold cathode to create a generally disc-shaped trapped electron beam discharge;

a workpiece positioned within said vacuum chamber means, adjacent one side of the dsc-shaped trapped electron beam discharge but outside the volume defined thereby, for receiving radiation from the disc-shaped trapped electron beam discharge;

vacuum control means coupled to said vacuum chamber means for establishing and maintaining a desired vacuum within said vacuum chamber means; and gas port means for admitting and controlling the flow of ambient and reactant gases into said vacuum chamber means.

2. An in-situ wide area vacuum ultraviolet radiation apparatus as in claim 1 further comprising a vacuum ultraviolet reflective coating positioned within said vacuum chamber means on an opposite side of said disc-shaped trapped electron beam discharge from the workpiece for directing backside radiation from the disc-shaped trapped electron beam discharge toward the workpiece.

3. An in-situ wide area vacuum ultraviolet radiation apparatus as in claim 1 wherein the inner surface of said ring-shaped cold cathode is formed to be concave for electrostatically trapping the disc-shaped trapped electron beam discharge within the ring-shaped cold cathode.

4. An in-situ wide area vacuum ultraviolet radiation apparatus as in claim 1 wherein the inner surface of said ring-shaped cold cathode is formed to be a U-shaped slot for electrostatically trapping the disc-shaped trapped electron beam discharge within the ring-shaped cold cathode.

5. An in-situ wide area vacuum ultraviolet radiation apparatus as in claim 1 further comprising coolant means for circulating a coolant within said ring-shaped cathode shell.

6. An in-situ wide area vacuum ultraviolet radiation apparatus as in claim 5 wherein the coolant comprises water.

7. An in-situ wide area vacuum ultraviolet radiation apparatus as in claim 5 wherein the coolant comprises a gas.

8. An in-situ wide area vacuum ultraviolet radiation apparatus as in claim 1 wherein said ring-shaped cathode shell is constructed of a ceramic material.

9. An in-situ wide area vacuum ultraviolet radiation apparatus as in claim 1 wherein:

said ring-shaped cathode shell is constructed of a metal and is spaced from said ring-shaped cold cathode a uniform distance; and the uniform distance by which said ring-shaped cold cathode is spaced from said ring-shaped cathode shell is occupied by an insulating material.

10. An in-situ wide area vacuum ultraviolet radiation apparatus as in claim 9 wherein said insulating material is a machinable material.

11. An in-situ wide area vacuum ultraviolet radiation apparatus as in claim 9 wherein said insulating material is aluminum oxide.

12. An in-situ wide area vacuum ultraviolet radiation apparatus as in claim 9 wherein said insulating material is bery.llium oxide.

13. An in-situ wide area vacuum ultraviolet radiation apparatus as in claim 9 wherein said insulating material is Mycor.

14. An in-situ wide area vacuum ultraviolet radiation apparatus as in claim 1 further comprising coolant means for circulating a coolant within said ring-shaped cold cathode.

15. An in-situ wide area vacuum ultraviolet radiation apparatus as in claim 14 wherein the coolant comprises water.

16. An in-situ wide area vacuum ultraviolet radiation apparatus as in claim 14 wherein the coolant comprises a gas.

17. An in-situ wide area vacuum ultraviolet radiation apparatus as in claim 1 wherein an ambient gas is helium.

18. An in-situ wide area vacuum ultraviolet radiation apparatus as in claim 1 wherein an ambient gas is deuterium.

19. An in-situ wide area vacuum ultraviolet radiation-apparatus-as in claim 1 wherein an ambient gas is nitrogen.

20. An in-situ wide area vacuum ultraviolet radiation apparatus as in claim 1 wherein an ambient gas is oxygen.

21. An in-situ wide area vacuum ultraviolet radiation apparatus as in claim 1 wherein the ambient gases are a mixture of hydrogen, deuterium, nitrogen, and oxygen.

22. An in-situ wide area vacuum ultraviolet radiation apparatus as in claim 1 wherein a reactant gas is an organically based gas.

23. An in-situ wide area vacuum ultraviolet radiation apparatus as in claim 1 wherein a reactant gas is an inorganically based gas.

24. A method for in-situ wide area VUV processing of a thin film substrate structure, the method comprising the steps of:

establishing a controlled gas atmosphere in an evacuated chamber, the controlled gas atmosphere including one or more ambient and one or more feedstock reactant gases;

producing a confined, disc-shaped electron beam discharge within the evacuated chamber using a ring-shaped cold cathode located within the evacuated chamber, the confined, disc-shaped electron beam discharge being produced adjacent a selected surface of the thin film substrate structure so that a planar axis of the confined, disc-shaped electron beam discharge is substantially parallel to the selected surface of the thin film substrate structure so as to dissociate molcules of the one or more feedstock reactant gases to produce dissociation products by electron beam interaction with the one or more ambient gases and to create both VUV radiation and a flux of atomic species from one or more of the dissociation products of feedstock reactant gases.

* * * * *